US009941047B2

(12) United States Patent
Ortiz

(10) Patent No.: US 9,941,047 B2
(45) **Date of Patent: *Apr. 10, 2018**

(54) SHIELD FOR TOROIDAL CORE ELECTROMAGNETIC DEVICE, AND TOROIDAL CORE ELECTROMAGNETIC DEVICES UTILIZING SUCH SHIELDS

(71) Applicant: Raytheon Company, Waltham, MA (US)

(72) Inventor: Joe A. Ortiz, Garden Grove, CA (US)

(73) Assignee: Raytheon Company, Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/018,099

(22) Filed: Feb. 8, 2016

(65) Prior Publication Data

US 2016/0155564 A1 Jun. 2, 2016

Related U.S. Application Data

(63) Continuation of application No. 13/723,471, filed on Dec. 21, 2012, now Pat. No. 9,257,224.

(51) Int. Cl.

| | |
|---|---|
| ***H01F 27/36*** | (2006.01) |
| ***H01F 27/28*** | (2006.01) |
| ***H01F 30/16*** | (2006.01) |
| ***H01F 27/24*** | (2006.01) |

(52) U.S. Cl.

CPC ..... *H01F 27/362* (2013.01); *H01F 27/24* (2013.01); *H01F 27/288* (2013.01); *H01F 27/2847* (2013.01); *H01F 30/16* (2013.01)

(58) Field of Classification Search

CPC ..... H01F 27/367; H01F 27/365
USPC ..... 336/84 C
See application file for complete search history.

(56) References Cited

U.S. PATENT DOCUMENTS

| | | | | |
|---|---|---|---|---|
| 1,989,183 | A * | 1/1935 | Blake | B65D 85/671 206/414 |
| 2,435,093 | A | 1/1948 | Mitschrich | |
| 2,897,294 | A * | 7/1959 | Lipkin | H01P 9/02 323/329 |
| 2,947,960 | A | 8/1960 | Fredrickson | |
| 3,292,127 | A | 12/1966 | Dormaier | |
| 3,336,662 | A * | 8/1967 | Howland | H01F 17/043 29/602.1 |
| 3,340,489 | A | 9/1967 | Bastis | |

(Continued)

*Primary Examiner* — Elvin G Enad
*Assistant Examiner* — Joselito Baisa
(74) *Attorney, Agent, or Firm* — Renner, Otto, Boisselle & Sklar, LLP

(57) ABSTRACT

A shield for a toroidal transformer that includes a toroidal assembly that comprises a toroidal magnetic core and a first winding includes a sheet of flexible non-magnetic conductive material. The sheet of flexible non-magnetic conductive material comprises a trunk portion extending along a longest dimension of the sheet of flexible non-magnetic conductive material and configured to wrap along an outer dimension of the toroidal assembly, and a plurality of fingers extending outwardly from the trunk portion and configured to wrap around portions of the first winding along portions of sides of the toroidal assembly in a direction towards the center of the toroidal magnetic core and folding into an inner dimension of the toroidal assembly.

20 Claims, 18 Drawing Sheets

(56) References Cited

U.S. PATENT DOCUMENTS 3,406,364 A * 10/1968 Russell ..... H01F 27/33 336/69
3,503,126 A 3/1970 Faller
3,517,361 A 6/1970 Reifel
3,518,595 A * 6/1970 Dawson ..... H01F 27/004 324/207.16
4,180,763 A * 12/1979 Anderson ..... H01J 65/048 313/17
4,459,576 A 7/1984 Fox et al.
4,472,703 A * 9/1984 Blackman ..... H02K 3/325 310/45
4,516,892 A * 5/1985 Curro, Jr. ..... B65H 75/185 206/413
4,612,455 A * 9/1986 Weiner ..... H03K 3/57 307/106
4,895,831 A * 1/1990 Laskaris ..... H01F 6/065 174/15.5
5,214,413 A * 5/1993 Okabayashi ..... G02B 26/127 345/7
5,717,552 A * 2/1998 Varian ..... G11B 5/11 360/125.01
5,828,282 A * 10/1998 Tiemann ..... H01F 27/365 336/174
6,236,209 B1 * 5/2001 Arz ..... G01R 33/385 324/309
6,407,470 B1 * 6/2002 Seelig ..... B60L 5/005 191/10
6,507,260 B1 * 1/2003 Baumann ..... H01F 27/324 336/229
6,653,924 B2 * 11/2003 Vinciarelli ..... H01F 27/346 336/212
6,753,749 B1 6/2004 Chin
7,425,096 B2 * 9/2008 Beyerlein ..... A61B 6/56 378/101
8,106,739 B2 * 1/2012 Shpiro ..... H01F 17/0033 29/602.1
8,238,066 B2 * 8/2012 Zylstra ..... G01R 15/183 361/42
2007/0188284 A1 * 8/2007 Dobbs ..... A61B 6/56 336/120

* cited by examiner

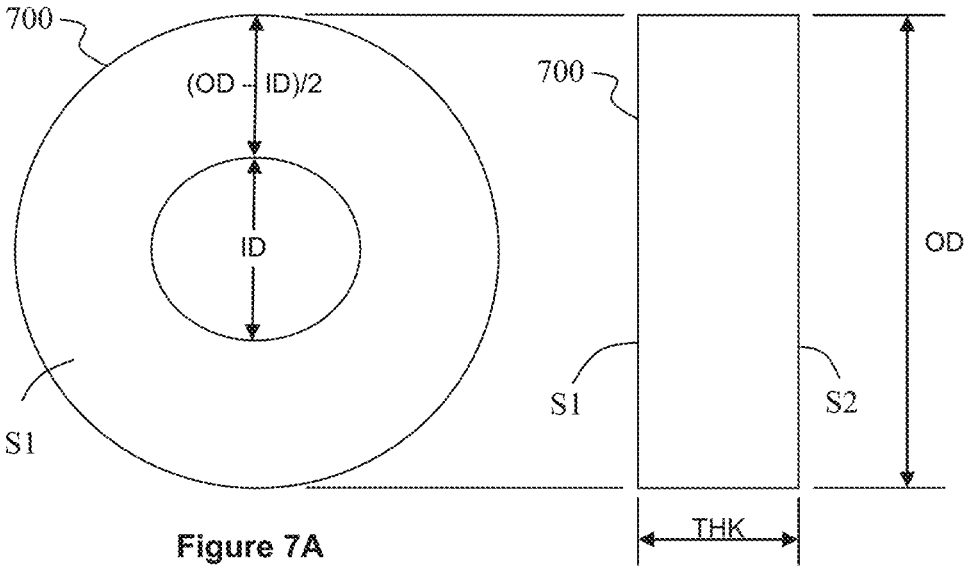
Figure 7A
Figure 7B
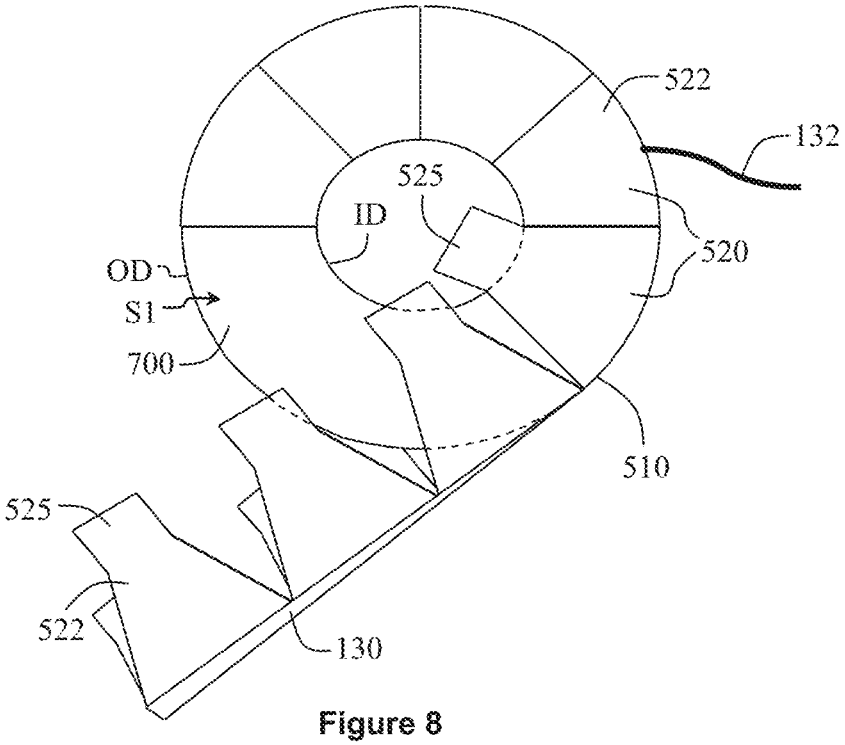
Figure 8

SHIELD FOR TOROIDAL CORE ELECTROMAGNETIC DEVICE, AND TOROIDAL CORE ELECTROMAGNETIC DEVICES UTILIZING SUCH SHIELDS

GOVERNMENT LICENSE RIGHTS

This invention was made with government support. The government has certain rights in the invention.

FIELD OF THE INVENTION

The present invention relates to a shield for a toroidal core electromagnetic device such as a transformer or inductor.

BACKGROUND

Electronics systems, such as communication systems, information systems, entertainment systems, radar systems, infrared sensor systems, laser tracking systems, or directed energy systems, whether commercial, ground-based, mobile, airborne, shipboard, or spacecraft systems, require DC power to operate the electronics. High frequency (≥50 kHz) switching power converters are the power conversion equipment of choice to provide the DC power for the electronics, being much more efficient, smaller, and lighter than linear power supplies.

Unfortunately, switch mode power conversion is not without its drawbacks. In some applications electronics systems require primary to secondary isolation or may have other requirements that may require the use of transformers. Common mode current capacitively coupled through the switching power converter's power transformer from primary to secondary may be a major source of noise in electronics systems using a switching power converter. Common mode current capacitively coupled from a wound magnetic assembly to chassis may be another major source of noise in electronics systems using a switching power converter.

If uncontrolled, common mode current may manifest itself as differential noise due to impedance mismatches between signal and signal return. This noise can wreak havoc in the electronics system by, for example, generation of false signals and false triggering of digital logic. Such noise has been known to prevent successful communication between electronics systems, rendering the electronics systems inoperable.

SUMMARY OF THE INVENTION

The present disclosure discloses systems and methods aimed at preventing generation and/or transmission of common mode current. One example application of the systems and methods disclosed herein is the prevention of generation and/or transmission of common mode current by capacitive coupling from primary to secondary of a toroidal power transformer. However, this invention is not limited to power transformers. This invention is usable in any toroidal core electromagnetic device including transformers and inductors.

Faraday shields may be used between primary and secondary of transformers to prevent current coupling through the transformer from primary to secondary or vice versa. However, Faraday shields have typically been limited to bobbin-wound transformers, due to the lack of an effective means to include Faraday shields in a toroidally wound magnetic assembly. A prior method to implement Faraday shields in toroidal transformers includes the winding of insulated copper strips around the toroidal core in the same manner as the windings. However, this method leads to shields that are relatively long and inductive and are therefore largely ineffective. Another method includes the use of a solid sheet of copper wrapped over a wound toroidal assembly. However, this method requires significant folding and creasing of the copper sheet to pass through the inner diameter of the wound toroidal assembly, creating significant increase in build height and significant reduction of the available inner diameter of the wound toroidal assembly.

The present disclosure discloses Faraday shields constructed to wrap in substantially one layer around the wound toroidal core assembly, thus providing an effective low-inductance shield with minimum increase in build height and minimum reduction in available inner diameter of the wound toroidal assembly. One or more of the shields disclosed herein, when utilized in a toroidal transformer, will significantly attenuate common mode noise coupled through the transformer. The present disclosure further discloses electromagnetic devices such as transformers that incorporate the disclosed shields.

One aspect of the present disclosure includes a shield for a toroidal transformer comprised of a sheet of flexible non-magnetic conductive material, usually thin copper sheet. The sheet of flexible non-magnetic conductive material includes a trunk portion extending along one dimension of the sheet of flexible non-magnetic conductive material and configured to wrap along the outer circumference of a wound toroidal assembly comprising a toroidal magnetic core and a primary winding, for example, and a plurality of fingers extending outward from the trunk portion and configured to wrap along the sides of the toroidal assembly in a direction towards the center of the wound toroidal assembly and wrap into the inner circumference of the wound toroidal assembly.

In one embodiment, the shield includes a wire electrically connected to the sheet of flexible non-magnetic conductive material.

In another embodiment, the shield includes an insulation layer bonded to the sheet of flexible non-magnetic conductive material.

In another embodiment, the shield includes an insulation layer bonded to each side of the sheet of flexible non-magnetic conductive material.

In yet another embodiment, at least some of the plurality of fingers have a portion adjacent the trunk portion and a portion distal the trunk portion, and the portion adjacent the trunk portion is wider than the portion distal the trunk portion.

In one embodiment, at least some of the plurality of fingers have a tapered portion adjacent the trunk portion and a non-tapered portion distal the trunk portion.

In another embodiment, the tapered portion has a first dimension substantially equal to the circumference of the outer diameter of the toroidal assembly divided by half the number of fingers in the plurality of fingers, and a second dimension substantially equal to the circumference of the inner diameter of the toroidal assembly divided by half the number of fingers in the plurality of fingers.

In yet another embodiment, the non-tapered portion distal the trunk portion has a dimension substantially equal to the circumference of the inner diameter of the toroidal assembly divided by half the number of fingers in the plurality of fingers.

In one embodiment, at least some of the plurality of fingers has a portion adjacent the trunk portion, and a portion distal the trunk portion, and the portion adjacent the trunk portion, or the trunk portion, has rounded stress relief cutouts, or, rounded stress relief cutouts cross from the portion adjacent the trunk portion into the trunk portion.

In one embodiment, at least some of the plurality of fingers have a portion adjacent the trunk portion, and a portion distal the trunk portion, and the portion adjacent the trunk portion, or the trunk portion, has some rounded cutouts for the passing of lead wires, or both the portion adjacent the trunk portion and the trunk portion have some rounded cutouts for the passing of lead wires, or, rounded cutouts for the passing of lead wires cross from the portion adjacent the trunk portion into the trunk portion, either with or without rounded stress relief cutouts.

Another aspect of the present disclosure includes a toroidal transformer comprising a toroidal assembly having an outer diameter, an inner diameter, and two sides. The toroidal assembly comprises a toroidal magnetic core, and a first winding or windings wrapped around a portion of the toroidal magnetic core. In one embodiment, the toroidal assembly comprises a layer of insulation wrapped over the first winding or windings. The toroidal transformer further comprises a first shield wrapped over at least a portion of the first winding or windings. The first shield comprises a flexible non-magnetic conductive sheet that includes a trunk portion extending along the outer circumference of the toroidal assembly and a plurality of fingers extending from the trunk portion along portions of the two sides of the toroidal assembly in a direction towards the center of the toroidal magnetic core and folding into the inner circumference of the toroidal assembly.

The fingers in the inner diameter of the toroidal assembly from one side may overlap the fingers from the other side, or the fingers may butt ends, but, ideally, the fingers from one side do not electrically short to the fingers from the other side and create a shorted turn through the inner diameter of the toroidal assembly.

In one embodiment, the toroidal transformer includes a second winding or windings wrapped around a portion of the first shield including a portion of the trunk portion and a portion of the plurality of fingers.

In another embodiment, the toroidal transformer includes an insulation layer wrapped over at least a portion of the first shield and a second winding or windings wrapped around the insulation layer and the first shield including a portion of the trunk portion and a portion of the plurality of fingers.

In another embodiment, the toroidal transformer includes an insulation layer wrapped over at least a portion of the first shield, wherein the insulation layer and the first shield are bonded together, and a second winding or windings wrapped around the insulation layer and the first shield including a portion of the trunk portion and a portion of the plurality of fingers.

In another embodiment, the toroidal transformer includes insulation layers wrapped over at least a portion of the first shield, wherein the insulation layers and the first shield are bonded together, such that the shield includes an insulation layer bonded to each side of the sheet of flexible non-magnetic conductive material, and a second winding or windings wrapped around the insulation layer and the first shield including a portion of the trunk portion and a portion of the plurality of fingers.

In yet another embodiment, the toroidal transformer includes an insulation layer wrapped over at least a portion of the first shield and a second shield wrapped over at least a portion of the insulation layer and the first shield, and a second winding or windings wrapped around the second shield including a portion of the trunk portion and a portion of the plurality of fingers. The second shield comprises a second flexible non-magnetic conductive sheet that includes a second trunk portion extending along the outer circumference of the toroidal assembly and a second plurality of fingers extending from the second trunk portion along portions of the two sides of the toroidal assembly in a direction towards the center of the toroidal magnetic core and folding into the inner circumference of the toroidal assembly.

In yet another embodiment, the toroidal transformer includes an insulation layer wrapped over the first shield and a second shield wrapped over the insulation layer and the first shield, an insulation layer wrapped over the second shield, and a second winding or windings wrapped around the second shield including a portion of the trunk portion and a portion of the plurality of fingers. The second shield comprises a second flexible non-magnetic conductive sheet that includes a second trunk portion extending along the outer circumference of the toroidal assembly and a second plurality of fingers extending from the second trunk portion along portions of the two sides of the toroidal assembly in a direction towards the center of the toroidal magnetic core and folding into the inner circumference of the toroidal assembly.

In yet another embodiment, the toroidal transformer includes an insulation layer wrapped over the first shield, wherein the insulation layer and the first shield are bonded together, such that the shield includes an insulation layer bonded to one side of the sheet of flexible non-magnetic conductive material, and a second shield wrapped over the insulation layer and the first shield, and an insulation layer wrapped over the second shield, wherein the insulation layer and the second shield are bonded together, such that the shield includes an insulation layer bonded to one side of the sheet of flexible non-magnetic conductive material, and a second winding or windings wrapped around the second shield including a portion of the trunk portion and a portion of the plurality of fingers. The second shield comprises a second flexible non-magnetic conductive sheet that includes a second trunk portion extending along the outer circumference of the toroidal assembly and a second plurality of fingers extending from the second trunk portion along portions of the two sides of the toroidal assembly in a direction towards the center of the toroidal magnetic core and folding into the inner circumference of the toroidal assembly.

In yet another embodiment, the toroidal transformer includes insulation layers wrapped over at least a portion of the first shield, wherein the insulation layers and the first shield are bonded together, such that the shield includes an insulation layer bonded to each side of the sheet of flexible non-magnetic conductive material, and a second shield wrapped over at least a portion of the insulation layer and the first shield, and insulation layers wrapped over the second shield, wherein two insulation layers and the second shield are bonded together, such that the shield includes an insulation layer bonded to each side of the sheet of flexible non-magnetic conductive material, and a second winding or windings wrapped around the insulated second shield including a portion of the trunk portion and a portion of the plurality of fingers. The second shield comprises a second flexible non-magnetic conductive sheet that includes a second trunk portion extending along the outer dimension of the toroidal assembly and a second plurality of fingers extending from the second trunk portion along portions of the two sides of the toroidal assembly in a direction towards the center of the toroidal magnetic core and folding into the inner circumference of the toroidal assembly.

In one embodiment, the toroidal transformer includes an insulation layer wrapped over at least a portion of the first shield, a second shield wrapped over at least a portion of the insulation layer and the first shield, and a second winding wrapped around a portion of the second shield including a portion of the second trunk portion and a portion of the second plurality of fingers. The second shield comprises a second flexible non-magnetic conductive sheet that includes a second trunk portion extending along the outer dimension of the toroidal assembly and a second plurality of fingers extending from the second trunk portion along portions of the two sides of the toroidal assembly in a direction towards the center of the toroidal magnetic core and folding into the inner circumference of the toroidal assembly.

In another embodiment, the toroidal transformer includes a wire electrically connected to the first shield.

In yet another embodiment, the toroidal transformer includes a first wire electrically connected to the first shield, and a second wire electrically connected to the second shield.

In one embodiment, at least some of the plurality of fingers of the shields have a portion adjacent the trunk portion and a portion distal the trunk portion. The portion adjacent the trunk portion is wider than the portion distal the trunk portion.

In yet another embodiment, the tapered portion of the shields has a first dimension substantially equal to the circumference of the outer diameter of the toroidal assembly divided by half the number of fingers in the plurality of fingers, and a second dimension substantially equal to the circumference of the inner diameter of the toroidal assembly divided by half the number of fingers in the plurality of fingers.

In one embodiment, the non-tapered portion of the shields has a dimension substantially equal to the circumference of the inner diameter of the toroidal assembly divided by half the number of fingers in the plurality of fingers.

In another embodiment, at least some of the plurality of fingers of the shields have a portion adjacent the trunk portion and a portion distal the trunk portion, and the portion adjacent the trunk portion, or the trunk portion, has rounded stress relief cutouts, or, rounded stress relief cutouts cross from the portion adjacent the trunk portion into the trunk portion.

In one embodiment, at least some of the plurality of fingers of the shields have a portion adjacent the trunk portion, and a portion distal the trunk portion, and the portion adjacent the trunk portion, or the trunk portion, has some rounded cutouts for the passing of lead wires, or both the portion adjacent the trunk portion and the trunk portion have some rounded cutouts for the passing of lead wires, or, rounded cutouts for the passing of lead wires cross from the portion adjacent the trunk portion into the trunk portion, either with or without rounded stress relief cutouts.

Common mode current capacitively coupled from a wound magnetic assembly to chassis may be another major source of noise in electronics systems using a switching power converter. Another aspect of the present disclosure includes a Faraday shield for a wound magnetic assembly comprised of a sheet of flexible non-magnetic conductive material, usually thin copper sheet, placed between a wound magnetic assembly and chassis or heat sink (or other mounting plane) to prevent current coupling from the outermost winding of the wound magnetic assembly to chassis (or other mounting plane), or vice versa. Embodiments of the shield may include a wire or other low-inductance lead to return common mode currents to the current source.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

FIGS. 7A and 7B illustrate front and side views, respectively, of an exemplary wound toroidal assembly.

FIG. 8 shows the transformer of FIGS. 3A and 3B during assembly to illustrate how the shield of FIG. 5 is installed onto the assembly of FIG. 7.

DETAILED DESCRIPTION

Figure 1A:
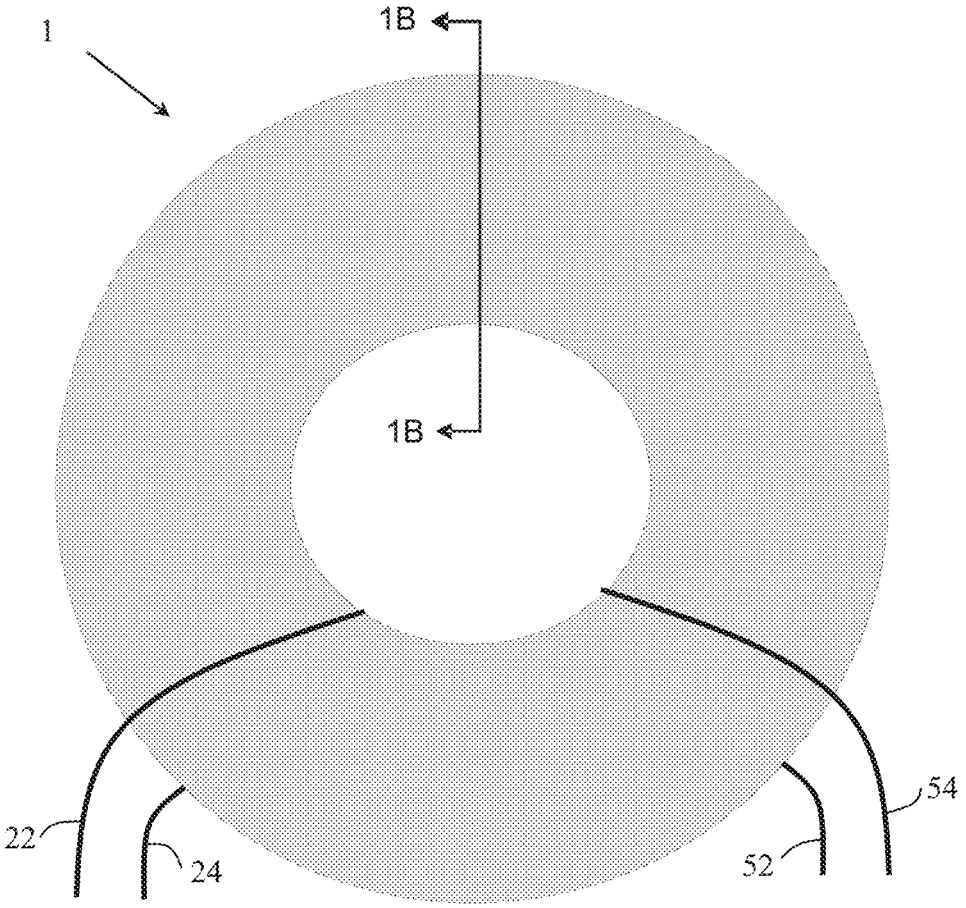
Figure 1A Prior Art
FIGS. 1A and 1B illustrate side and cross-sectional views, respectively, of an exemplary toroidal core transformer.
Figure 1B:
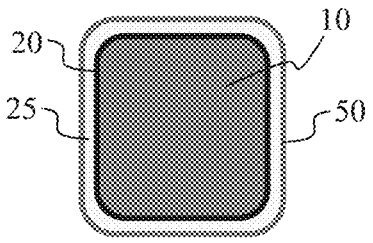

FIGS. 1A and 1B illustrate side and cross-sectional views, respectively, of an exemplary toroidal core transformer 1. The transformer 1 includes a toroidal magnetic core 10 and a first winding 20 wrapped around the toroidal magnetic core 10. The first winding 20 has lead wires 22 and 24. The transformer 1 further includes an insulation layer 25 between the first winding 20 and a second winding 50. The second winding 50 wraps around the insulation layer 25, and has lead wires 52 and 54. In other embodiments, the transformer 1 includes more than two windings.

The term winding as used here in reference to, for example, the first winding 20 and the second winding 50 includes, not only a single conductor winding (i.e., a winding that includes only one conductor), but also a multiple conductor winding (i.e., a winding that includes more than one conductor regardless of whether those conductors are connected to each other), and an interleaved winding (e.g., the first half of the primary winding is wound, the secondary winding is wound over the first half of the primary winding and then the second half of the primary winding is wound over the secondary winding). The terms first winding and second winding as used here in reference to, for example, the first winding 20 and the second winding 50 do not necessarily correspond to a primary winding and a secondary winding, respectively. For example, the first and the second winding may correspond to two secondary windings.

Although magnetic cores, such as the core 10, and assemblies including magnetic cores are described herein as being circular or toroidal, or having circumference or diameter, magnetic cores and assemblies including magnetic cores disclosed herein may include cores and assemblies that are non-circular (e.g., oval shaped, square shaped, etc.)

FIGS. 1A and 1B illustrate how a capacitance is built between the first winding 20 and the second winding 50. The first winding 20 and the second winding 50 form a coaxial interwinding capacitance of a magnitude determined by the effective winding length, the effective winding width, the thickness of the insulation between the first winding 20 and the second winding 50, and the dielectric constant of the insulation 25.

Figure 2:
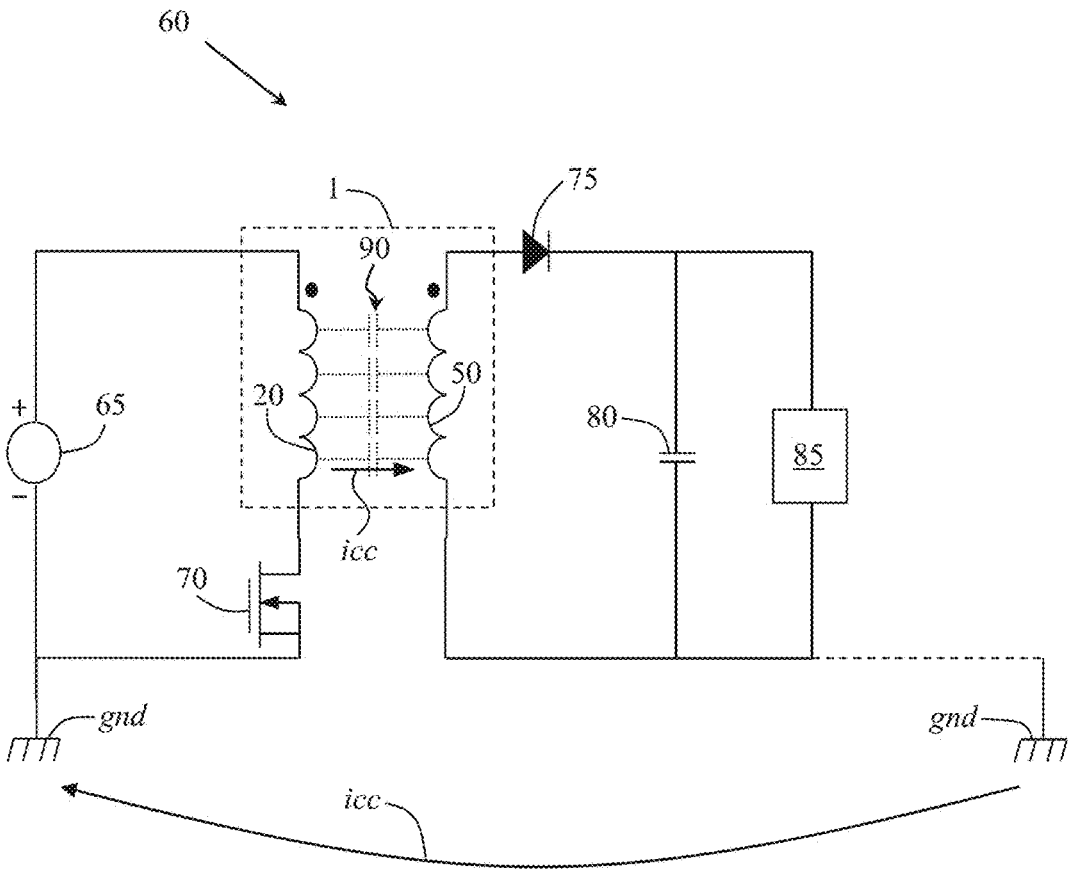
Prior Art Figure 2
FIG. 2 illustrates a schematic diagram of a circuit incorporating the transformer of FIGS. 1A and 1B.

FIG. 2 illustrates a schematic drawing of a circuit 60 incorporating the transformer 1. The circuit 60 includes a voltage source 65 coupled to the first winding 20 of the transformer 1. The circuit 60 further includes a transistor 70 connected between the first winding 20 of the transformer 1 and the voltage source 65. Connected to the second winding 50 of the transformer 1 is a diode 75, which in turns connects to an output capacitor 80 that provides power to a load 85. During operation, the transistor 70 switches causing an AC voltage to appear across the first winding 20, which in turn causes an AC voltage to appear across the second winding 50. The diode 75 rectifies the AC voltage appearing on the second winding 50 causing a DC voltage to appear across the capacitor 80, which delivers power to the load 85.

FIG. 2 further illustrates the interwinding capacitance discussed above in reference to FIGS. 1A and 1B. The interwinding capacitance is illustrated as capacitors 90. Through the capacitors 90, common mode current icc is coupled from primary to secondary through the transformer 1 and returned to the common mode noise source in the primary through chassis ground gnd.

Figure 3A:
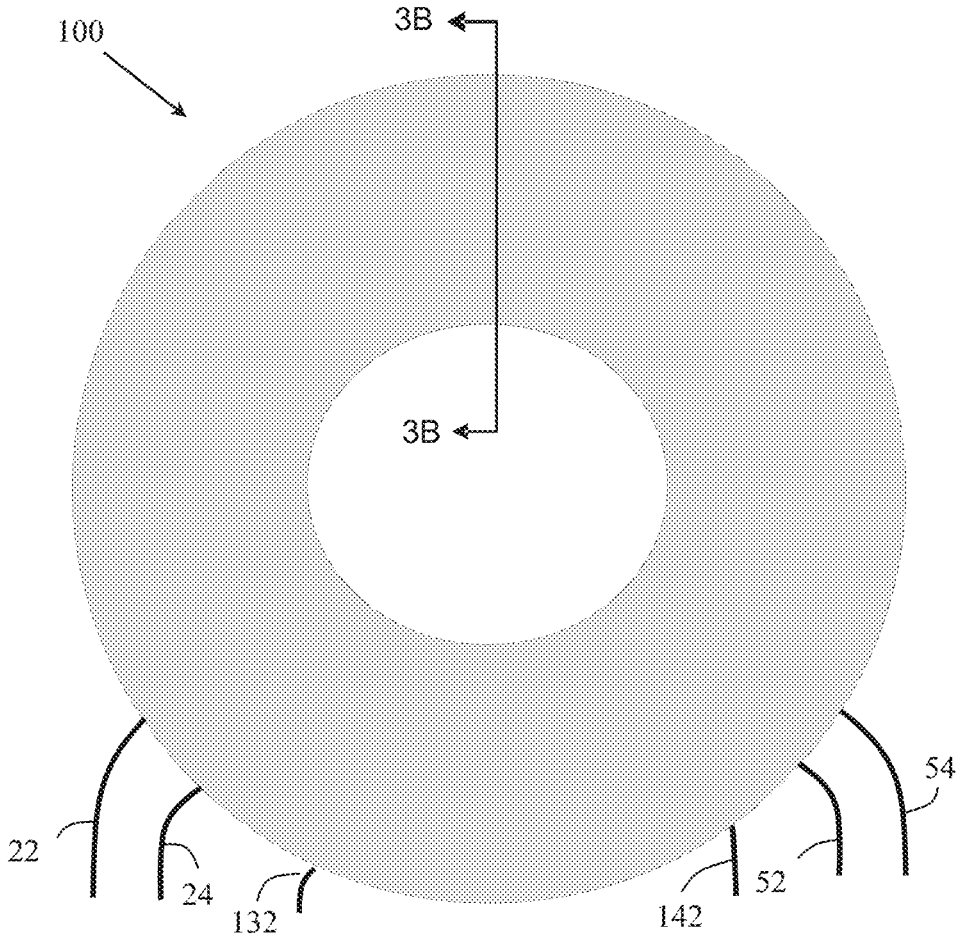
FIGS. 3A and 3B illustrate side and cross-sectional views, respectively, of an exemplary toroidal core transformer incorporating Faraday shields.
Figure 3B:
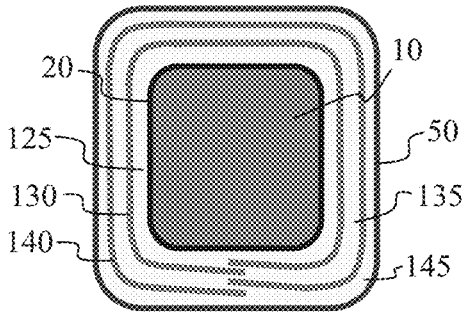

FIGS. 3A and 3B illustrate side and cross-sectional views, respectively, of an exemplary toroidal core transformer 100. The transformer 100 includes a toroidal magnetic core 10 and a first winding 20 wrapped around the toroidal magnetic core 10. The first winding 20 wraps around the toroidal magnetic core 10 and has lead wires 22 and 24. The transformer 100 also includes a first shield 130 covering the first winding 20. The first shield 130 wraps around the first winding 20 in substantially one layer with only minimum overlapping. This wrapping in one layer provides very low inductance of the first shield 130, yet also provides complete coverage of the first winding 20. The first shield 130 has a lead wire 132 that serves to connect the first shield 130 to ground as discussed in more detail below.

FIG. 3B illustrates an insulation layer 125 between the first winding 20 and the first shield 130. The insulation layer 125, as well as any other insulation layer disclosed herein, may be a discrete insulation layer as illustrated in FIG. 3B, or the insulation layer 125 may be a plural number of layers of insulation as required by the particular application of the transformer 100, or the insulation layer 125 may be, not a discrete layer or plural number of layers, but a distributed electrical insulation layer. For example, magnetic wire is often coated with a layer of insulation.

In the illustrated embodiment, the transformer 100 further includes a second insulation layer 135 covering the first shield 130, and a second shield 140 wrapped over the insulation layer 135 around the first winding 20. The second shield 140 wraps around in substantially one layer with only minimum overlapping. Similar to the first shield 130 above, this wrapping in one layer provides very low inductance of the second shield 140, yet also provides complete coverage around the toroidal shape. The second shield 140 has a lead wire 142 that serves to connect the second shield 140 to ground as discussed in more detail below. The transformer 100 of FIG. 3B further includes a second winding 50 isolated from the second shield 140 by a third layer of insulation 145. The second winding 50 has lead wires 52 and 54. In one embodiment, the transformer 100 includes a single shield, first shield 130 for example, and thus does not include additional shields or corresponding insulation layers. In other embodiments, for example where the transformer 100 includes more than two windings, the transformer 100 may include more than two shields and a corresponding number of insulation layers, such as would be used for interleaved primary and secondary windings, for example, in which two shields would be used between each primary group of windings and each secondary group of windings.

FIGS. 3A and 3B, therefore, illustrate how capacitances between first winding 20 and first shield 130, and between second shield 140 and second winding 50 are built into the transformer 100. The first winding 20 and first shield 130 form a coaxial capacitance of a magnitude determined by the effective winding/shield length, the effective winding/shield width, the thickness of the insulation 125 between first winding 20 and first shield 130, and the dielectric constant of the insulation 125. Similarly, the second winding 50 and second shield 140 form a coaxial capacitance of a magnitude determined by the effective winding/shield length, the effective winding/shield width, the thickness of the insulation 145 between second winding 50 and second shield 140, and the dielectric constant of the insulation 145. In one embodiment, the transformer 100 includes only one shield. In other embodiments, the transformer 100 includes more than two shields. FIGS. 3A and 3B also illustrate how capacitance between first shield 130 and second shield 140 is built into the transformer 100. However, as will be seen, essentially no common mode current flows between these shields through the capacitance.

Figure 4:
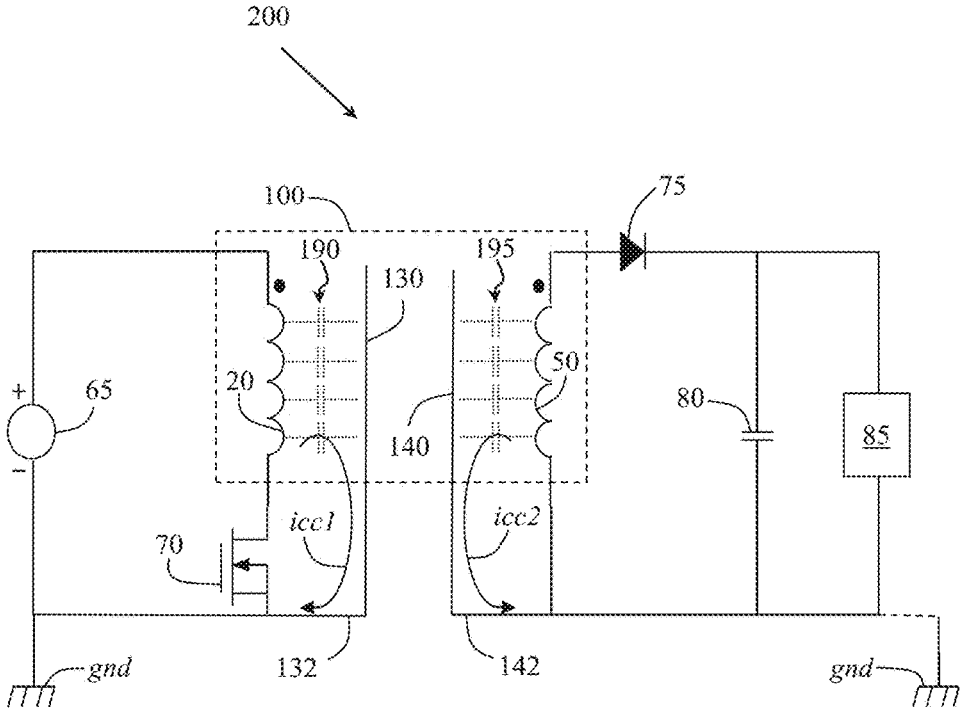
FIG. 4 illustrates a schematic diagram of a circuit corresponding to the circuit of FIG. 2, but with the transformer replaced by the transformer of FIGS. 3A and 3B.

FIG. 4 illustrates a schematic drawing of a circuit 200 which corresponds to the circuit 60 discussed above, but with the transformer 1 replaced by the transformer 100. General operation of the circuit 200 is described above in reference to circuit 60 and thus is not repeated here. The transformer 100 includes shields 130 and 140, which each has a wire lead, 132 and 142 respectively, that connects the shields 130 and 140 to ground gnd. In one embodiment, the transformer 100 includes only one shield. In other embodiments, the transformer 100 includes more than two shields.

FIG. 4 further illustrates the winding/shield capacitances discussed above in reference to FIGS. 3A and 3B. The capacitance associated with the first shield 130 is labeled capacitors 190 and the capacitance associated with the second shield 140 is labeled capacitors 195. Common mode current icc1 flowing into the first winding 20 is effectively coupled to ground gnd and returned to the common mode noise source through capacitors 190, shield 130 and lead wire 132, preventing the common mode current icc1 from being transmitted to the second winding 50 and into the secondary of the circuit 200. Similarly, common mode current icc2 flowing into the second winding 50 is effectively coupled to ground gnd and returned to the common mode noise source through capacitors 195, shield 140 and lead wire 142, preventing the common mode current icc2 from being transmitted to the first winding 20 and into the primary of the circuit 200. FIG. 4 further illustrates the shield-to-shield capacitances discussed above in reference to FIGS. 3A and 3B. While there is capacitance between the shields, given that each of the two shields is normally tied to chassis ground with sufficient EMI filter design and decoupling to chassis, and short non-inductive shield leads, there is very little, if not zero, AC voltage between the shields, and therefore essentially zero common mode current flows between these shields through the shield-to-shield capacitance.

In the illustrated embodiment, the first winding 20 illustrated as the primary winding and the second winding 50 as the secondary winding. In other embodiments, the first winding 20 is the secondary winding of the transformer and the second winding 50 is the primary winding. In other embodiments, the transformer 100 may include more than two windings and two shields, such as would be used for interleaved primary and secondary windings, for example.

Figure 5:
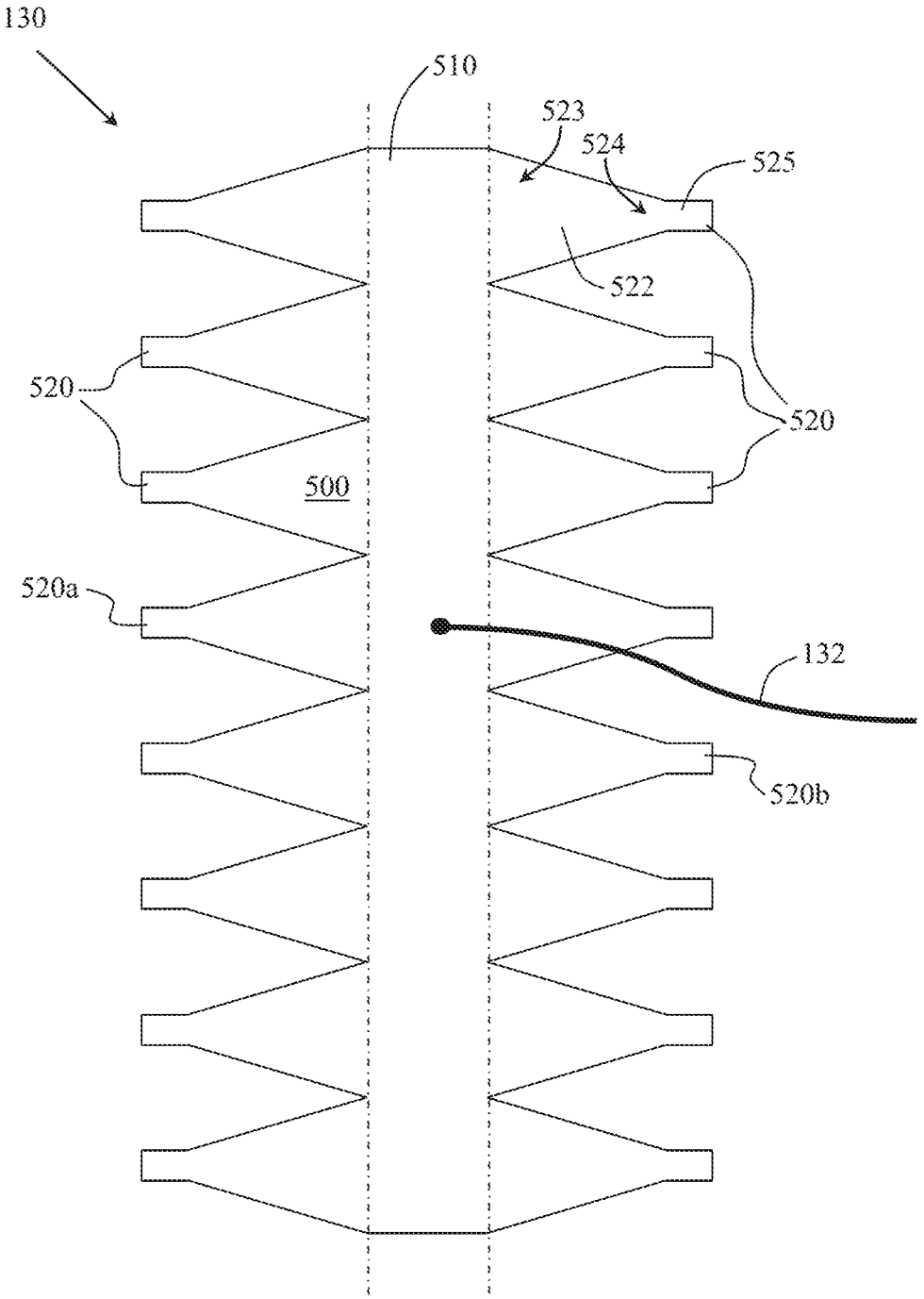
FIG. 5 illustrates an exemplary Faraday shield.

FIG. 5 illustrates an exemplary shield 130. The shield 130 includes a sheet 500 of flexible non-magnetic conductive material. The flexible non-magnetic conductive material from which the sheet 500 is fabricated may be one or a combination of such materials including, for example, copper, silver, aluminum, lead, magnesium, platinum and tungsten. The sheet 500 includes a trunk portion 510 extending along the length or possibly a longest dimension of the sheet 500. The trunk portion 510 is designed, as discussed in more detail below, to wrap around the outer circumference of a toroidal assembly including the magnetic core 10 and the first winding 20. The sheet 500 also includes a plurality of fingers 520, exemplary of which are fingers 520*a* and 520*b*, that extend outward from the trunk portion 510. The fingers 520 are designed, as discussed in more detail below, to wrap along the sides of a toroidal assembly including the magnetic core 10 and the first winding 20 in a direction towards the center of the toroidal magnetic core 10 and folding into the inner circumference of the toroidal assembly.

In the illustrated embodiment, the fingers 520 have a tapered portion 522 adjacent the trunk portion 510 and a non-tapered portion 525 distal the trunk portion 510. The tapered portion 522 has a portion 523 adjacent the trunk portion 510 and a portion 524 distal the trunk portion 510. The portion 523 adjacent the trunk portion 510 is wider than the portion 524 distal the trunk portion 510.

The shield 130 further includes the lead wire 132 electrically connected to the sheet 500. In one embodiment, the wire 132 is soldered to the sheet 500. In other embodiments, the wire 132 is electrically connected to the sheet 500 by methods other than soldering. In the illustrated embodiment, the wire 132 is shown as connected to the sheet 500 towards a central area or the middle of the sheet 500. In other embodiments, the wire 132 connects to the sheet 500 at other areas of the sheet 500.

Figure 6:
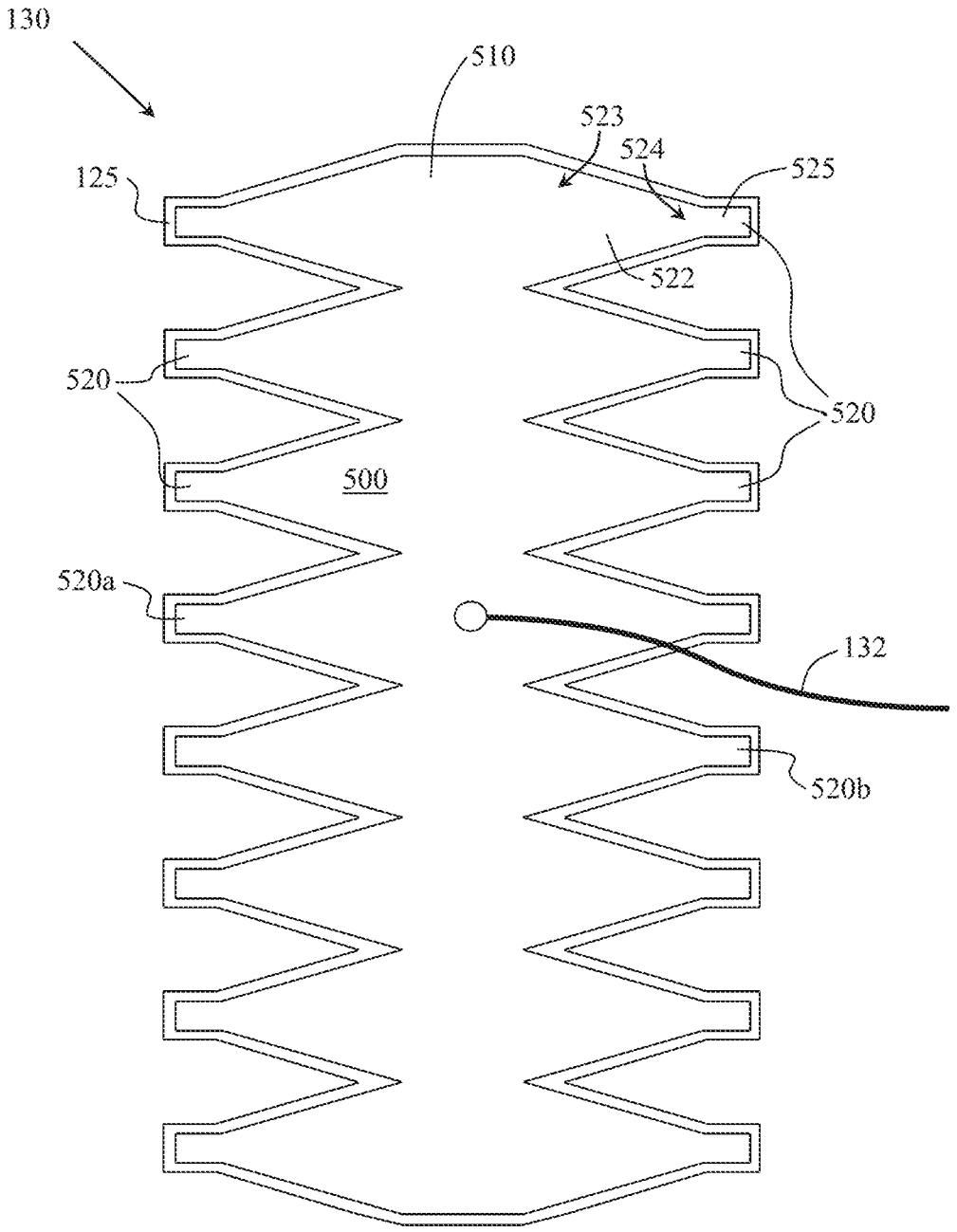
FIG. 6 illustrates the exemplary shield of FIG. 5 including an insulation layer.

FIG. 6 illustrates the exemplary shield 130 including the insulation layer 125 bonded to the sheet 500. In one embodiment, the insulation layer 125 is bonded to the sheet 500 with an adhesive. In other embodiments, the insulation layer 125 is bonded to the sheet 500 by methods other than an adhesive. In one embodiment, the combination of the sheet 500 and the insulation layer 125 may be produced from a metallized insulation material such as Kapton or equivalents. In this approach, unneeded flexible non-magnetic conductor material (e.g., copper) may be etched away similar to the etching process used to produce printed circuit boards (PCB). For shields with insulation on both sides, the flexible non-magnetic conductor material may then be covered by an insulating sheet (e.g., Kapton), and the insulation may be cut to desired dimensions, as shown in FIG. 6.

FIGS. 7A and 7B illustrates front and side views, respectively, of an exemplary wound toroidal assembly 700. The assembly 700 corresponds to the transformer 100 just prior to installation of the first shield 130. Thus, in reference to the illustrated embodiment of FIGS. 3A and 3B, the assembly 700 corresponds to an assembly including the toroidal core 10 and the first winding 20. The assembly 200 may also include the first insulation layer 125 depending on whether or not the first insulation layer 125 is part of the first shield as disclosed in reference to FIG. 6. The toroidal assembly 700 has an inner diameter, ID, an outer diameter, OD, sides S1 and S2, and a thickness THK.

FIG. 8 shows the assembly 700 during installation of the shield 130. The shield 130 is installed with the trunk portion 510 wrapped circumferentially around the outer circumference of the assembly 700. The sides S1 and S2 of the toroidal assembly 700 are wrapped substantially by the tapered portions 522 of the fingers 520. The inside circumference of the toroidal assembly 700 is wrapped by the non-tapered portions 525 of the fingers 520, which may overlap or butt ends, but does not short electrically from one side to the other side creating a shorted turn. Thus the fingers 520 wrap along portions of the sides S1 and S2 of the toroidal assembly 700 in a direction towards the center of the toroidal magnetic core 10 and folding into the inner circumference of the toroidal assembly 700.

As can be seen in FIG. 8, the shield 130 covers the toroid assembly 700 completely or almost completely, yet with minimum overlap of the shield 130 on the sides S1 and S2 and the inner dimension ID of the assembly 700 due to the particular shape of the shield 130. Among other advantages, minimum overlap minimizes build height due to the shield 130, which allows for a larger window for windings.

Figure 9:
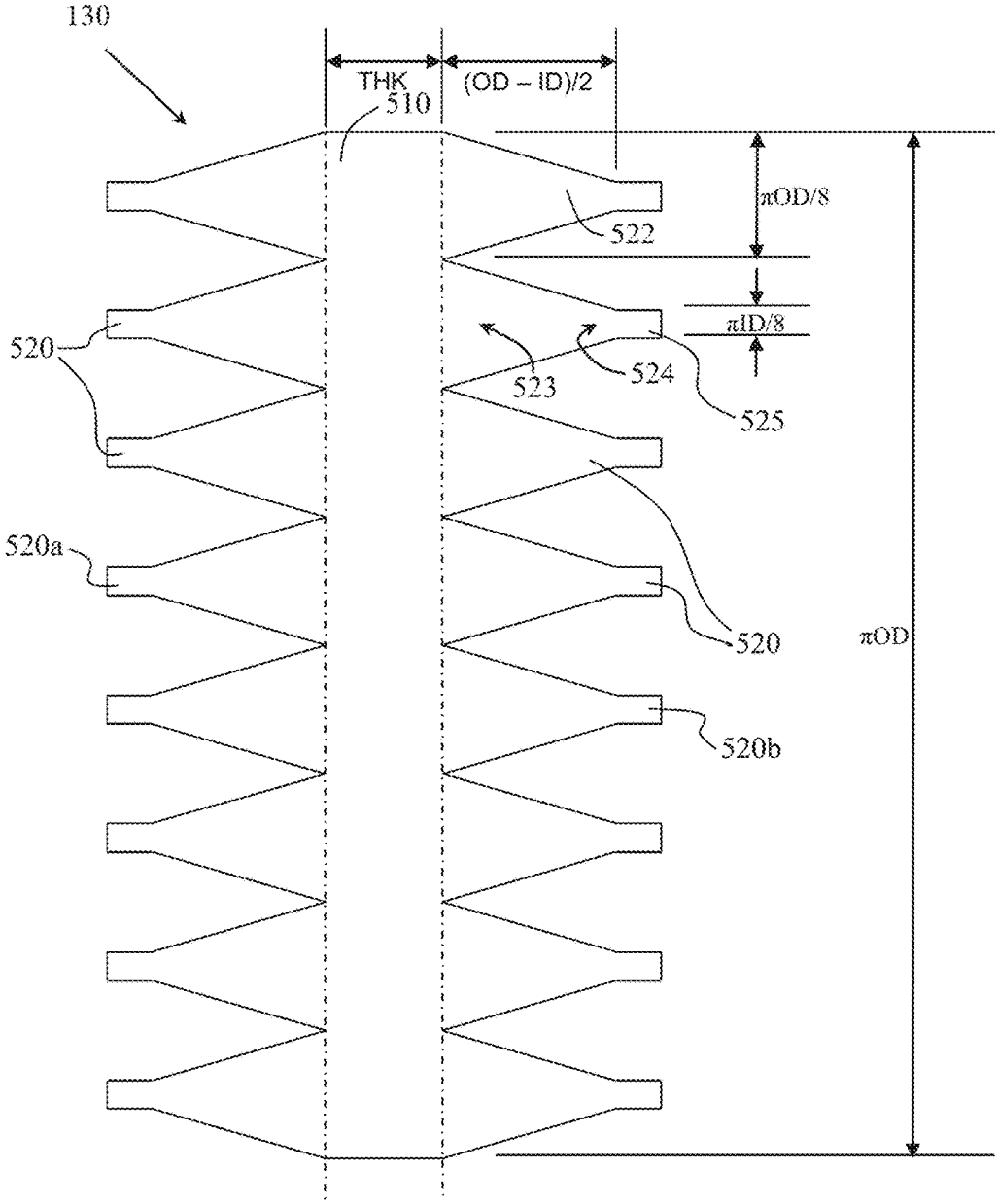
FIG. 9 illustrates an embodiment of a shield including 16 fingers.

FIG. 9 illustrates an embodiment of the shield 130 including 16 fingers 520. The shield 130 of FIG. 9 is designed to fit the toroidal assembly 700 of FIG. 7 and hence is illustrated with dimensions corresponding to the toroidal assembly 700. In the illustrated embodiment, the trunk portion 510 has a length equal to the circumference of the outer circumference ($\pi$OD) of the toroidal assembly 700 and a width equal to the thickness THK of the toroidal assembly 700. The tapered portion 522 has a length substantially equal to half the difference between the outer diameter and the inner diameter (OD−ID)/2 of the toroidal assembly 700.

In one embodiment, the portion 523 of the tapered portion 522 adjacent the trunk portion 510 has a dimension substantially equal to the circumference of the outer diameter of the toroidal assembly 700 divided by half the number of fingers 520, 2πOD/f, where f is the number of fingers. The portion 524 of the tapered portion 522 distal the trunk portion 510 has a dimension substantially equal to the circumference of the inner diameter of the toroidal assembly 700 divided by half the number of fingers 520, 2πID/f. In one embodiment, the non-tapered portion 525 has a dimension substantially equal to the circumference of the inner diameter of the toroidal assembly 700 divided by half the number of fingers 520, 2πID/f.

In the illustrated embodiment, the portion 523 adjacent the trunk portion 510 has a dimension substantially equal to one eighth the circumference of the outer diameter of the toroidal assembly 700, πOD/8. The non-tapered portion 525 has a dimension equal to one eighth the circumference of the inner diameter of the assembly 700, πID/8.

The width of the overlap of the shield 130 may be changed by changing the dimension shown in FIG. 9 as πOD/8, for example, πOD/7, and the dimension shown as πID/8 to, for example, πID/7. The length of the overlap of the shield 130 may be changed by changing the length of the non-tapered portion 525 as desired.

Figure 10:
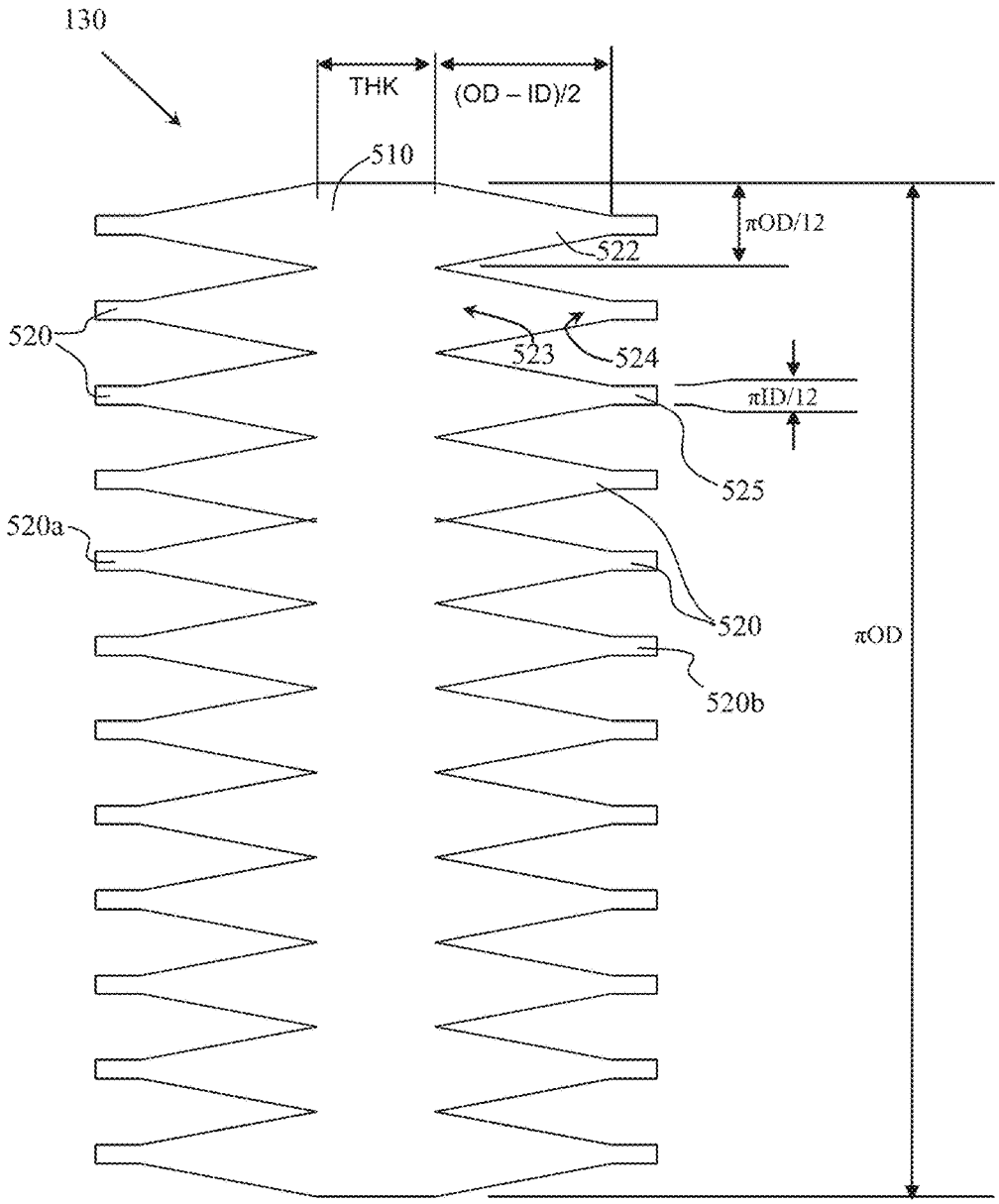
FIG. 10 illustrates an embodiment of a shield including 24 fingers.

FIG. 10 illustrates an embodiment of the shield 130 including 24 fingers 520. In the illustrated embodiment of FIG. 10, the portion 523 adjacent the trunk portion 510 has a dimension substantially equal to one twelfth the circumference of the outer diameter of the toroidal assembly 700, πOD/12. The non-tapered portion 525 has a dimension equal to one twelfth the circumference of the inner diameter of the assembly 700, πID/12.

The width of the overlap of the shield 130 may be changed by changing the dimension shown in FIG. 10 as πOD/12 to, for example, πOD/11, and the dimension shown as πID/12 to, for example, πID/11. The length of the overlap of the shield 130 may be changed by changing the length of the non-tapered portion 525 as desired.

Figure 11:
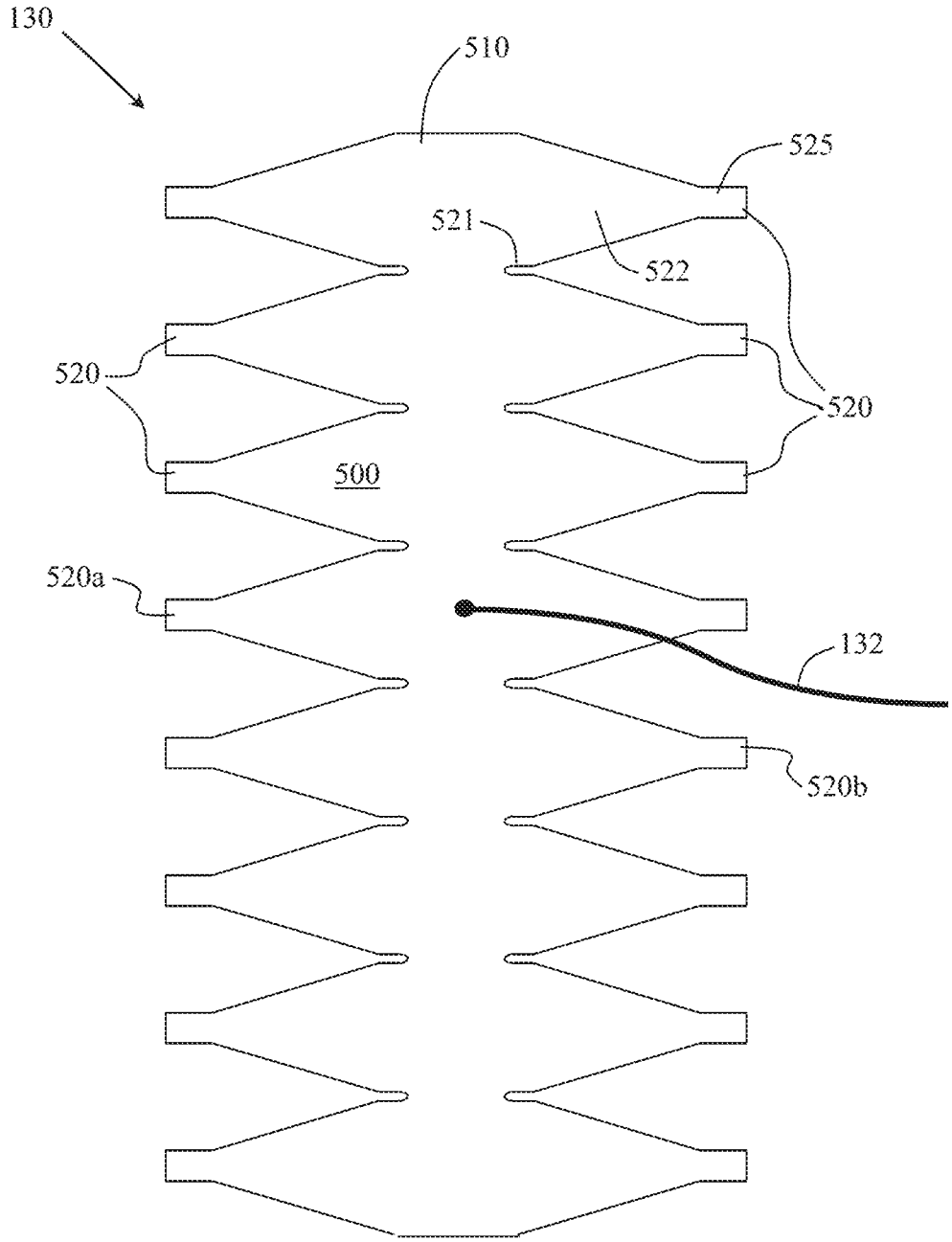
FIG. 11 illustrates an embodiment of a shield where fingers have a portion adjacent a trunk portion, and a portion distal the trunk portion, and crossing from the portion adjacent the trunk portion into the trunk portion are stress relief cutouts.

FIG. 11 illustrates an embodiment of the shield 130 where the fingers 520 have a portion 522 adjacent the trunk portion 510, a portion 525 distal the trunk portion, and crossing from the portion adjacent the trunk portion 522 into the trunk portion 510 are rounded stress relief cutouts.

Figure 12:
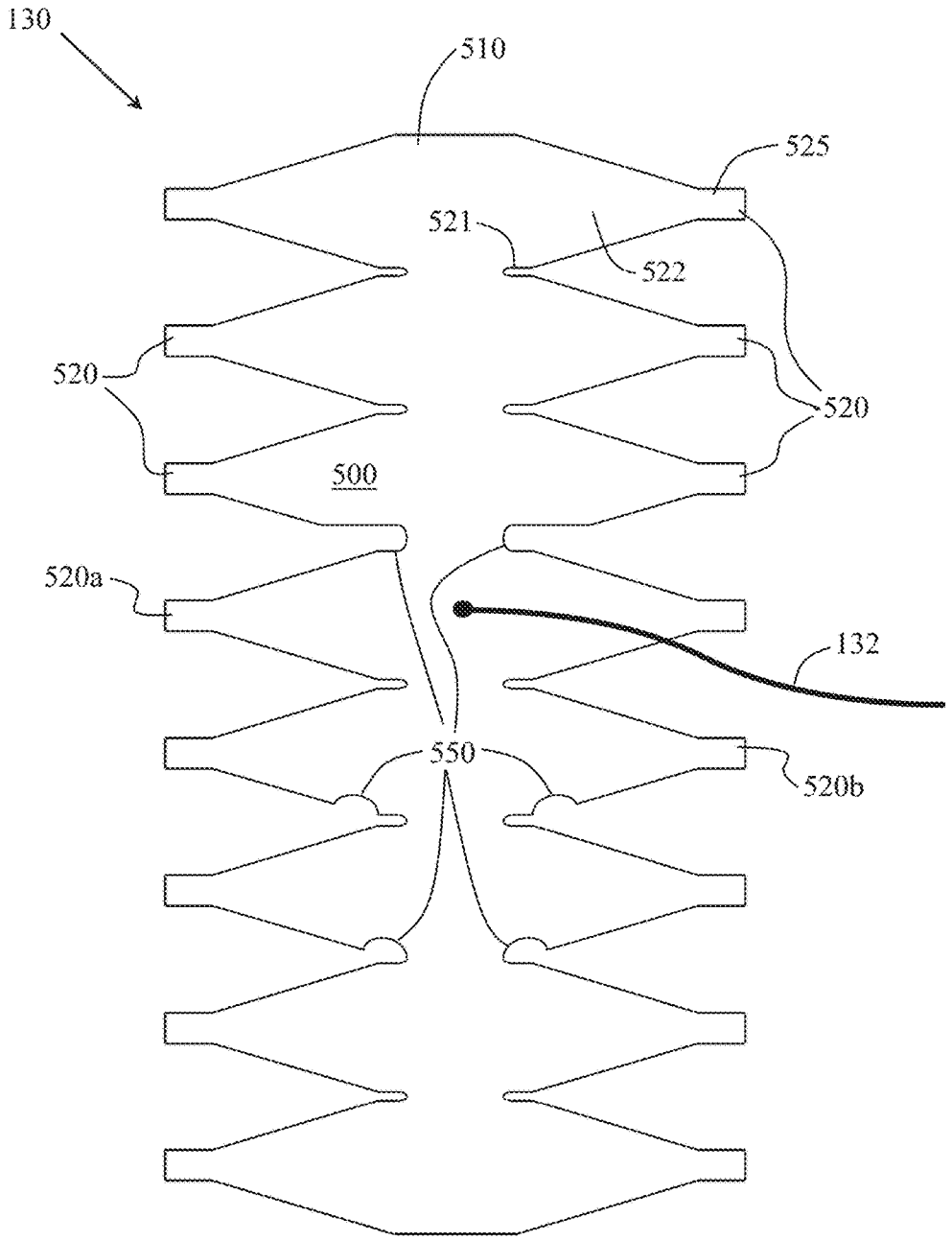
FIG. 12 illustrates an embodiment of a shield where some fingers have notches for routing of lead wires, the trunk portion has some rounded cutouts for the passing of lead wires, and crossing from the tapered portion into the trunk portion are some rounded cutouts for the passing of lead wires, with rounded stress relief cutouts.

FIG. 12 illustrates an embodiment of a shield where some fingers have rounded notches for routing of lead wires, the trunk portion has some rounded cutouts for the passing of lead wires, and crossing from the tapered portion into the trunk portion are some rounded cutouts for the passing of lead wires, with also rounded stress relief cutouts. Although, the cutouts are shown as rounded, the cutouts may have other shapes.

FIG. 12 illustrates an embodiment of the shield 130 where some fingers 520 have rounded notches 550 for routing of lead wires, the trunk portion has some rounded cutouts 550 for the passing of lead wires, and crossing from the tapered portion into the trunk portion are some rounded cutouts 550 for the passing of lead wires, with also rounded stress relief cutouts.

Figure 13:
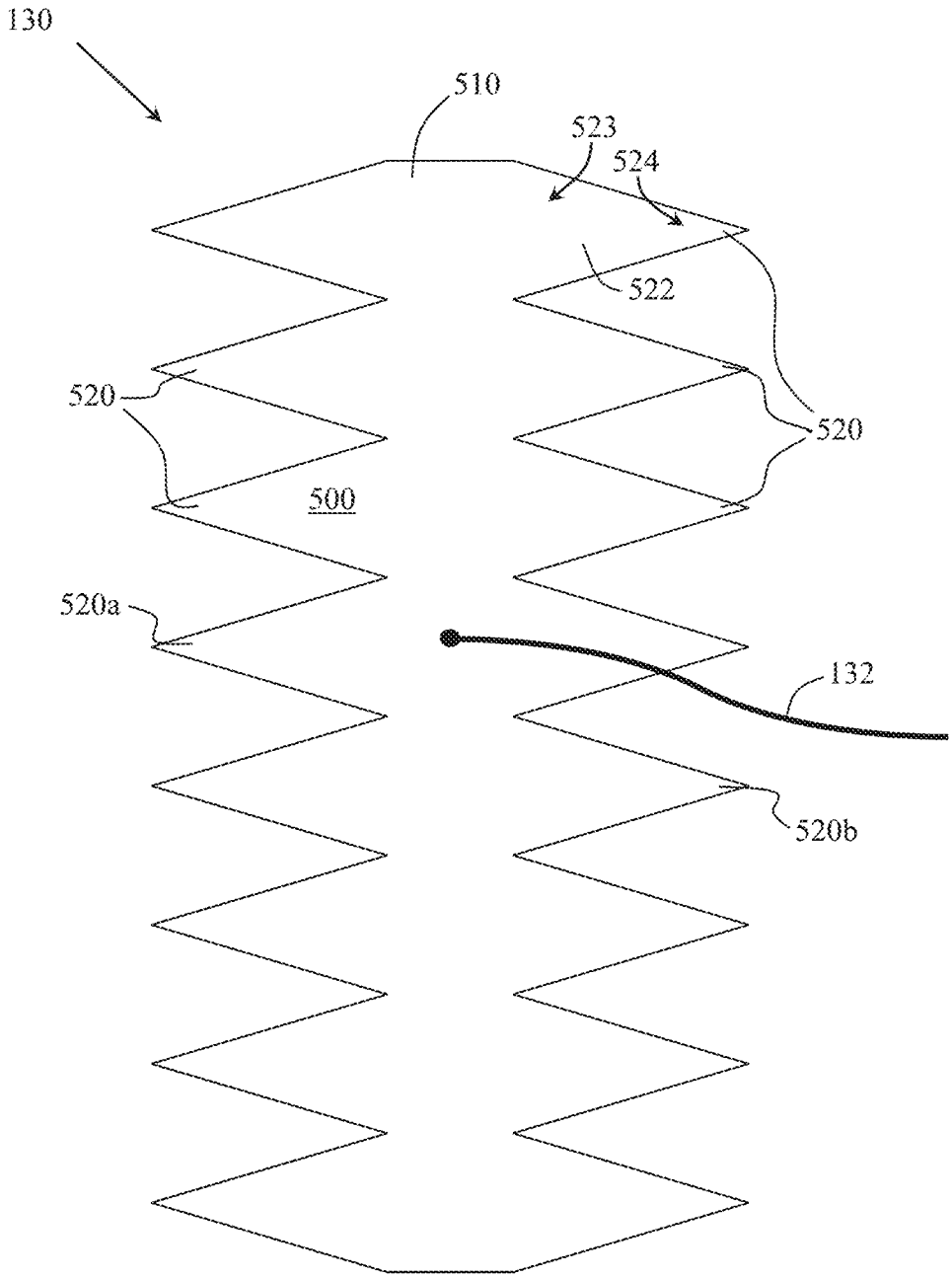
FIG. 13 illustrates an embodiment of a shield where fingers include only a tapered portion.

FIG. 13 illustrates an embodiment of the shield 130 where the fingers 520 do not include the non-tapered portion 525, but only the tapered portion 522. Thus, in the illustrated embodiment, the fingers 520 have the tapered portion 522, which includes a portion 523 adjacent the trunk portion 510 and a portion 524 distal the trunk portion 510. The portion 523 adjacent the trunk portion is wider than the portion 524 distal the trunk portion 510.

Figure 14:
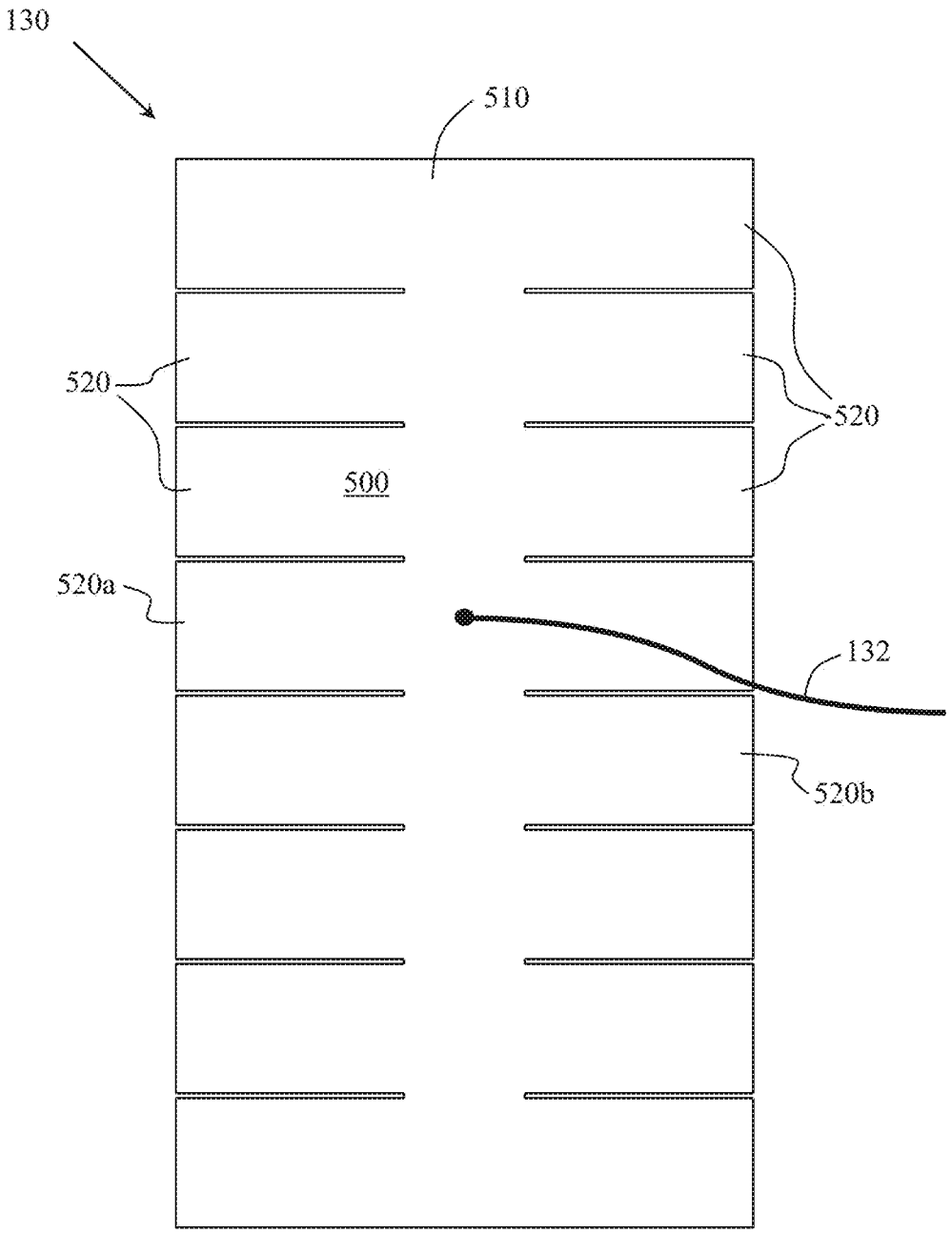
FIG. 14 illustrates yet another embodiment of a shield.

FIG. 14 illustrates yet another embodiment of the shield 130. In the illustrated embodiment, the shield includes the trunk portion 510 and the fingers 520. The fingers 520 are substantially straight in length (non-tapered). The illustrated approach would result in substantial overlap and build of the fingers 520 of the shield 130 and thus larger consumption of the winding window of the core 10 than the embodiments disclosed above.

Figure 15:
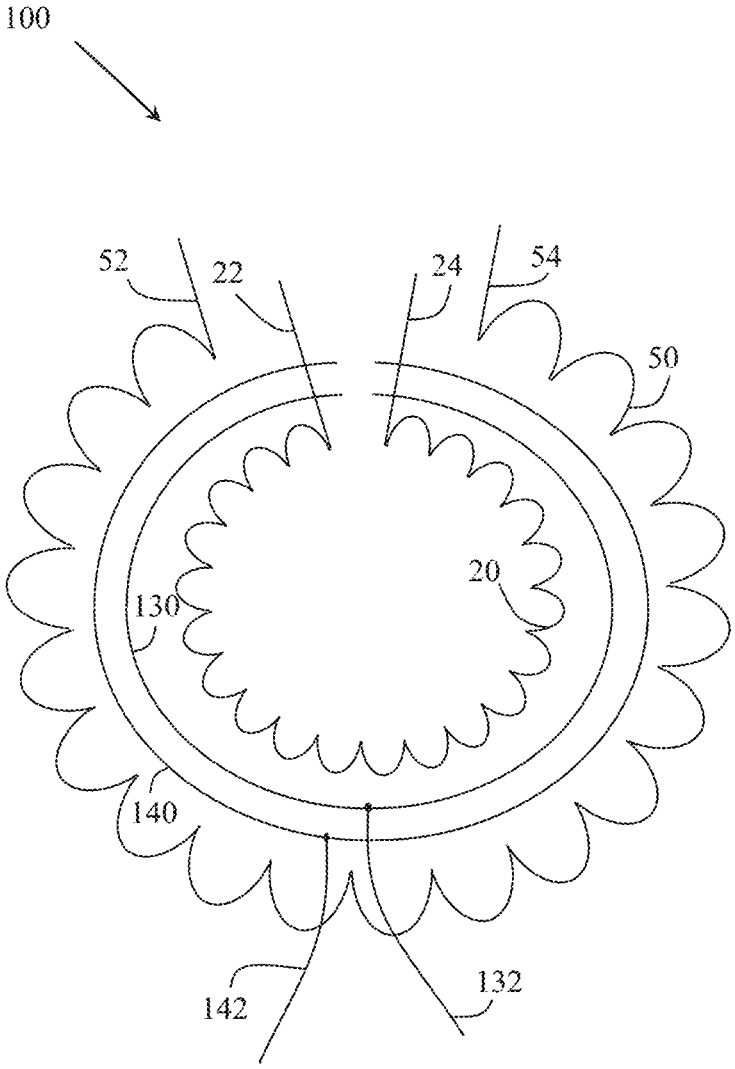
FIGS. 15 and 16 illustrate schematic drawings of potential winding schemes for the transformer of FIGS. 3A and 3B.
Figure 16:
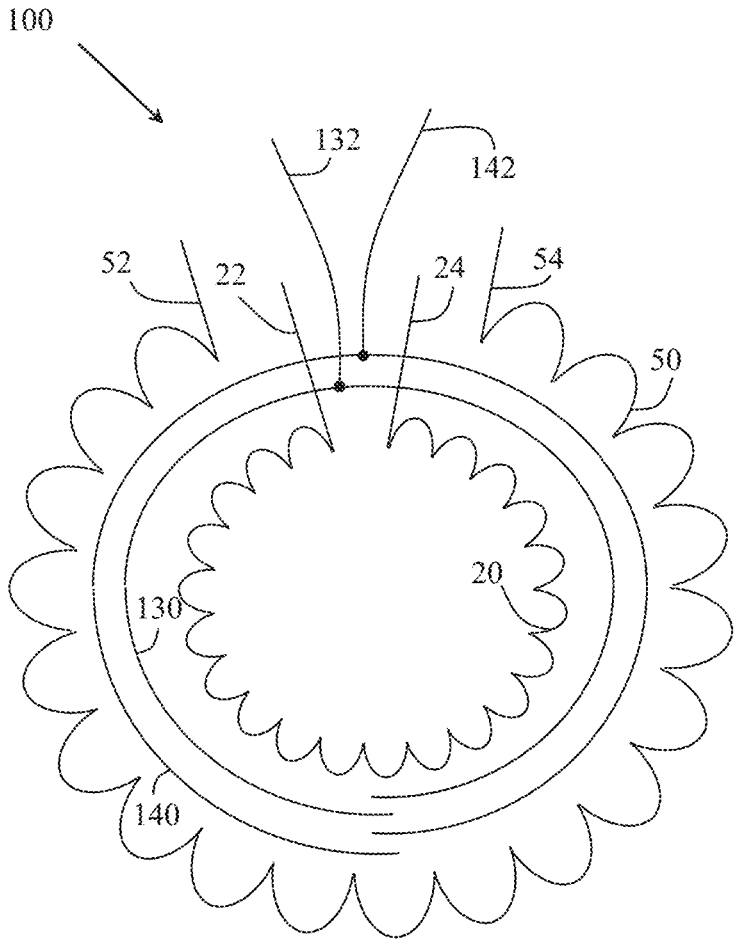

FIGS. 15 and 16 illustrate schematic drawings of potential winding schemes for the transformer 100. As discussed above, the transformer 100 includes the first winding 20, which has lead wires 22 and 24, the first shield 130 that has a lead wire 132 and wraps around the first winding 20, the second shield 140 that has the lead wire 142 and wraps around the first shield 130 and the first winding 20, and the second winding 50 that has lead wires 52 and 54 and wraps around the second shield 140, the first shield 130 and the first winding 20.

FIG. 15 shows an embodiment where the transformer 100 is constructed with the first shield 130 located such that the ends of the shield are near the location where the lead wires 22 and 24 exit the first winding 20, and the shield lead wire 132 is located close to the middle of the first winding 20. Similarly, the second shield 140 is located such that the ends of the shield are near the location where the lead wires 52 and 54 exit the second winding 50, and the shield lead wire 142 is located close to the middle of the second winding 50. This embodiment is not ideal. In a switching power supply transformer, one end of the winding is, or both ends of the winding are, the locations having the highest dv/dt, and thus is or are the areas of the winding having the highest capacitive current couple into the shield. By positioning the shield lead wire 132 away from the ends of the winding 20, the area or areas of the winding 20 having the greatest common mode current coupled into the shield 130 are placed away from the shield lead 132. The common mode current must conduct through the inductance of the shield between the end of the end of the shield and the middle of the shield, which reduces the effectiveness of the shield 130. In like manner, the effectiveness of the second shield 140 is also reduced.

FIG. 16 shows an embodiment where the transformer 100 is constructed with the first shield 130 located such that the middle of the shield 130 and the shield wire 132 are near the location where the lead wires 22 and 24 exit the first winding 20, that is to say near the ends of the winding 20. Similarly, the second shield 140 is located such that the middle of the shield 140 and the shield wire 142 are near the location where the lead wires 52 and 54 exit the second winding 50, that is to say near the ends of the winding 50. This embodiment is an improvement upon the embodiment of FIG. 15. By positioning the shield lead wire 132 close to the ends of the winding 20, the area or areas of the winding 20 having the greatest common mode current coupled into the shield 130 are placed next to the shield lead 132. The common mode current must now conduct through a very short length of the shield, with very little inductance, to the shield lead 132, which maximizes the effectiveness of the shield 130. In like manner, the effectiveness of the second shield 140 is also maximized.

Figure 17:
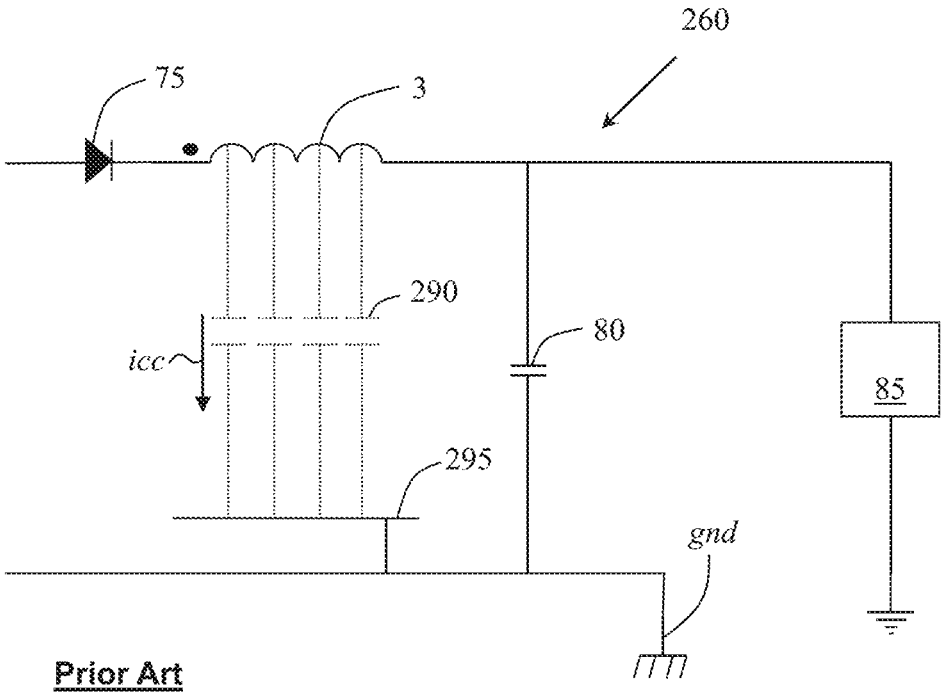
FIG. 17 illustrates a schematic drawing of a circuit incorporating a wound magnetic mounted to a heat sink, which is connected to chassis ground.
Figure 18:
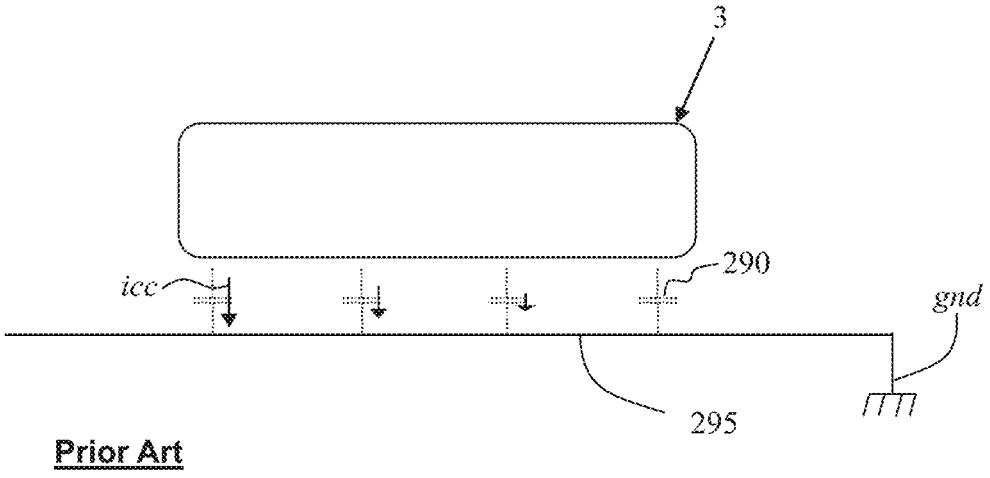
FIG. 18 illustrates pictorially the wound magnetic and the capacitance coupling the wound magnetic to the heat sink, which is connected to chassis ground.

Common mode current capacitively coupled from a wound magnetic assembly to chassis may be another major source of noise in electronics systems using a switching power converter. Another aspect of the present disclosure includes a Faraday shield for a wound magnetic assembly comprised of a sheet of flexible non-magnetic conductive material, usually thin copper sheet, placed between a wound magnetic assembly and chassis or heat sink (or other mounting plane) to prevent current coupling from the outermost winding of the wound magnetic assembly to chassis (or other mounting plane), or vice versa. Embodiments of the shield may include a wire or other low-inductance lead to return common mode currents to the current source. Often power magnetics including those with toroidal cores are mounted on heat sinks to provide conductive cooling. These heat sinks are often electrically tied to ground chassis. Any significant voltage waveform on the outermost winding of the toroidal wound magnetic can couple capacitively to the heat sink and from there to chassis ground creating common mode current to chassis. The common mode current will find its own return path to the common mode noise source through chassis ground. FIG. 17 illustrates a schematic drawing of a circuit 260 incorporating a wound magnetic 3 mounted to a heat sink 295 which is connected to chassis ground gnd. In the circuit 260 the wound magnetic 3 is part of a power converter output section consisting also of a diode 75 and an output capacitor 80 that provides power to a load 85. FIG. 17 further illustrates a capacitance illustrated as capacitors 290 that represents the capacitance between the wound magnetic 3 and the heat sink 295. FIG. 18 illustrates pictorially the wound magnetic 3 and the capacitance 290 coupling the wound magnetic 3 to the heat sink 295, which is connected to chassis ground gnd. Therefore, through the capacitors 290 and the heat sink 295, common mode current icc is coupled to chassis ground gnd.

Figure 19:
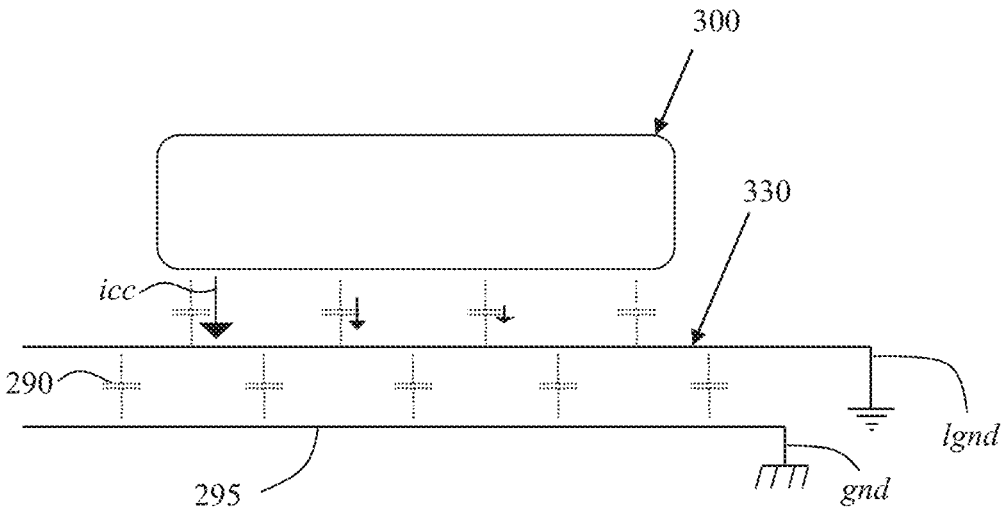
FIG. 19 illustrates pictorially a toroidal wound magnetic with a shield between the wound magnetic and the heat sink to which the wound magnetic is mounted, to prevent common mode coupling from the wound magnetic to ground.

FIG. 19 illustrates pictorially a toroidal wound magnetic 300 (either a transformer or an inductor) with a shield 330 between the wound magnetic 300 and the heat sink 295 to prevent common mode coupling. The shield may be a tight-fitting shield similar to the shields, such as shield 130, disclosed herein, or may be a simple thin flat sheet of conductive material, typically thin copper sheet, insulated from both the wound magnetic assembly and the mounting plane. The shield is connected to a local circuit ground Ignd. The common mode current icc flows from the wound magnetic 300 to the shield 330 and out to the local ground Ignd where the current icc is returned to the noise source. The current icc does not flow through the capacitance 290 and thus the wound magnetic 300 is not common mode coupled to the heat sink 295. Thus, the shield 330 prevents common mode coupling of the toroidal wound magnetic 300 to chassis ground gnd.

In one embodiment (not shown), for example in military or space electronics applications in which encapsulated magnetic are used, a shield may be placed internal to the encapsulated package.

Transformers with two windings, and single shield and two shield embodiments are discussed and shown in this disclosure for illustration purposes. However, the subject matter disclosed is applicable to transformers of more than two windings or single winding devices such as inductors. The subject matter disclosed is also applicable to applications utilizing several windings on either primary or secondary side, interleaved primary and secondary windings and applications that utilize more than two primary or secondary shields.

Although the invention has been shown and described with respect to certain illustrated embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the illustrated embodiment of the invention.

We claim:

1. A toroidal transformer comprising:

a toroidal assembly having an outer dimension, an inner dimension, and two sides, the toroidal assembly comprising:

a toroidal magnetic core, and a first winding wrapped around a portion of the toroidal magnetic core; and a first shield wrapped over at least a portion of the first winding, the first shield comprising a flexible non-magnetic conductive sheet including:

a trunk portion extending along the outer dimension of the toroidal assembly, and a plurality of fingers including a first set of multiple fingers and a second set of multiple fingers, the first set of multiple fingers extending from the trunk portion along portions of a first side of the two sides of the toroidal assembly in a direction towards the center of the toroidal magnetic core and folding into the inner dimension of the toroidal assembly, and the second set of multiple fingers extending from the trunk portion along portions of a second side of the two sides of the toroidal assembly in the direction towards the center of the toroidal magnetic core and folding into the inner dimension of the toroidal assembly such that ends of the first set of multiple fingers overlap ends of the second set of multiple fingers.

2. The toroidal transformer of claim 1 comprising:

a second winding wrapped over a portion of the first shield including a portion of the trunk portion and a portion of the plurality of fingers.

3. The toroidal transformer of claim 1 comprising:

an insulation layer wrapped over at least a portion of the first shield, wherein the insulation layer and the first shield are bonded together.

4. The toroidal transformer of claim 1 comprising:

an insulation layer wrapped over at least a portion of the first shield; and a second shield wrapped over at least a portion of the insulation layer, the second shield comprising a second flexible non-magnetic conductive sheet including:

a second trunk portion extending around a portion of the insulating layer along the outer dimension of the toroidal assembly, and a second plurality of fingers extending from the second trunk portion along portions of the two sides of the toroidal assembly in a direction towards the center of the toroidal magnetic core and folding into the inner dimension of the toroidal assembly.

5. The toroidal transformer of claim 1, comprising:

an insulation layer wrapped over at least a portion of the first shield;

a second shield wrapped over at least a portion of the insulation layer, the second shield comprising a second flexible non-magnetic conductive sheet including:

a second trunk portion extending around a portion of the insulating layer along the outer dimension of the toroidal assembly, and a second plurality of fingers extending from the second trunk portion along portions of the two sides of the toroidal magnetic core in a direction towards the center of the toroidal magnetic core and into the inner dimension of the toroidal assembly; and a second winding wrapped around a portion of the second shield including a portion of the second trunk portion and a portion of the second plurality of fingers.

6. The toroidal transformer of claim 1, comprising;

a first insulation layer wrapped over at least a portion of the first shield;

a second shield wrapped over at least a portion of the first insulation layer, the second shield comprising a second flexible non-magnetic conductive sheet including:

a second trunk portion extending around a portion of the insulating layer along the outer dimension of the toroidal assembly, and a second plurality of fingers extending from the second trunk portion along portions of the two sides of the toroidal magnetic core in a direction towards the center of the toroidal magnetic core and folding into the inner dimension of the toroidal assembly;

a second insulation layer wrapped over at least a portion of the second shield; and a second winding wrapped around a portion of the second insulation layer and the second shield including a portion of the second trunk portion and a portion of the second plurality of fingers.

7. The toroidal transformer of claim 1, wherein at least some of the plurality of fingers of the first shield have a portion adjacent the trunk portion and a portion distal the trunk portion, and wherein the portion adjacent the trunk portion is wider than the portion distal the trunk portion.

8. The toroidal transformer of claim 1, wherein at least some of the plurality of fingers of the first shield have a tapered portion adjacent the trunk portion and a non-tapered portion distal the trunk portion.

9. The toroidal transformer of claim 8, wherein the tapered portion has a first dimension substantially equal to the circumference of the outer dimension of the toroidal assembly divided by half the number of fingers in the plurality of fingers, and a second dimension substantially equal to the circumference of the inner dimension ($\pi\times$inner dimension) of the toroidal assembly divided by half the number of fingers in the plurality of fingers.

10. The toroidal transformer of claim 8, wherein the non-tapered portion has a dimension substantially equal to the circumference of the inner dimension of the toroidal assembly divided by half the number of fingers in the plurality of fingers.

11. The toroidal transformer of claim 1, wherein at least some of the plurality of fingers of the first shield have a portion adjacent the trunk portion and a portion distal the trunk portion, and the trunk portion or the portion adjacent the trunk portion has rounded stress relief cutouts, or rounded stress relief cutouts cross from the portion adjacent the trunk portion into the trunk portion.

12. A shield for a toroidal transformer including a toroidal assembly comprising a toroidal magnetic core and a first winding, the shield comprising:

a sheet of flexible non-magnetic conductive material, the sheet comprising:

a trunk portion extending along a longest dimension of the sheet of flexible non-magnetic conductive material and configured to wrap along an outer dimension of the toroidal assembly, and a plurality of fingers extending radially from the trunk portion in a first direction and configured to wrap around portions of the first winding along portions of a first side of the toroidal assembly in a direction towards the center of the toroidal magnetic core and to fold into an inner dimension of the toroidal assembly such that ends of the plurality of fingers overlap another portion of the sheet.

13. The shield of claim 12 comprising:

an insulation layer bonded to the sheet of flexible non-magnetic conductive material.

14. The shield of claim 12, wherein at least some of the plurality of fingers have a portion adjacent the trunk portion and a portion distal the trunk portion, and wherein the portion adjacent the trunk portion is wider than the portion distal the trunk portion.

15. The shield of claim 12, wherein at least some of the plurality of fingers have a tapered portion adjacent the trunk portion and a non-tapered portion distal the trunk portion.

16. The shield of claim 15, wherein the tapered portion has a first dimension substantially equal to the circumference of the outer dimension of the toroidal assembly divided by half the number of fingers in the plurality of fingers, and a second dimension substantially equal to the circumference of the inner dimension of the toroidal assembly divided by half the number of fingers in the plurality of fingers.

17. The shield of claim 16, wherein the non-tapered portion distal the trunk portion has a dimension substantially equal to the circumference of the inner dimension of the toroidal assembly divided by half the number of fingers in the plurality of fingers.

18. The shield of claim 15, wherein the non-tapered portion distal the trunk portion has a dimension substantially equal to the circumference of the inner dimension of the toroidal assembly divided by half the number of fingers in the plurality of fingers.

19. The shield of claim 12, wherein at least some of the plurality of fingers have a portion adjacent the trunk portion and a portion distal the trunk portion, and the trunk portion or the portion adjacent the trunk portion has rounded stress relief cutouts, or rounded stress relief cutouts cross from the portion adjacent the trunk portion into the trunk portion.

20. The shield of claim 12, comprising:

a second plurality of fingers extending radially from the trunk portion in a second direction opposite the first direction and configured to wrap around portions of the first winding along portions of a second side of the toroidal assembly in the direction towards the center of the toroidal magnetic core and to fold into the inner dimension of the toroidal assembly such that the ends of the first plurality of fingers overlap ends of the second plurality of fingers.

* * * * *